United States Patent [19]

Wilson

[11] Patent Number: 4,716,435

[45] Date of Patent: Dec. 29, 1987

[54] HEAT AND PRESSURE ROLL FUSER AND ROLL ENGAGING MECHANISM THEREFOR

[75] Inventor: Jack O. Wilson, Rochester, N.Y.

[73] Assignee: Xerox Corporation, Stamford, Conn.

[21] Appl. No.: 802,890

[22] Filed: Nov. 29, 1985

[51] Int. Cl.[4] ..... G03G 15/20

[52] U.S. Cl. ..... 355/3 FU; 100/281; 100/168; 100/176; 100/93 RP; 74/520

[58] Field of Search ..... 355/3 FU, 14 FU; 219/216, 469; 432/60; 100/93 RP, 168, 176, 281; 74/106, 520, 97, 100 R

[56] References Cited

U.S. PATENT DOCUMENTS

| | | | |
|---|---|---|---|
| 4,104,963 | 8/1978 | Fortmann | 100/176 |
| 4,265,138 | 5/1981 | Sato | 74/520 X |
| 4,280,443 | 7/1981 | Bogoshiam | 118/60 |
| 4,464,985 | 8/1984 | Asanuma et al. | 100/47 |
| 4,498,757 | 2/1985 | Lance et al. | 355/3 FU |
| 4,598,990 | 7/1986 | Kusumoto et al. | 355/3 FU |

*Primary Examiner*—Arthur T. Grimley
*Assistant Examiner*—J. Pendegrass

[57] ABSTRACT

Mechanism for effecting pressure engagement between two roll fuser members used for fusing toner images to copy substrates. The mechanism is characterized by simplicity of design and serviceability. To this end, one of two roll fuser members is supported on bearing surfaces such that it is lifted or raised upwardly through engagement with the other fuser member as it is moved upwardly. Upward movement of the last mentioned roll is effected by pair of lever arms which serve as the support for that roll. Each lever arm is operatively attached to an overcenter toggle structure which is actuatable either by rotary or linear motion of an actuator mechanism.

An adjustment device is provided for varying the load applied to the rolls.

9 Claims, 5 Drawing Figures

HEAT AND PRESSURE ROLL FUSER AND ROLL ENGAGING MECHANISM THEREFOR

BACKGROUND OF THE INVENTION

This invention relates generally to xerographic copying apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset". Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene, known by the tradename Teflon to which a release agent such as silicone oil is applied, the thickness of the Teflon being on the order of several mils and the thickness of the oil being less than 1 micron. Silicone based (polydimethylsiloxane) oils which possesses a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate such as the solid Teflon outer surface or covering of the aforementioned arrangement.

Heretofore, fuser roll structures of the type described above have not been easy to service and adjustment of the nip pressures has not been easily achievable. As will be appreciated, a heat and pressure roll fuser that is readily serviceable and which is readily adjustable for changing the nip pressure is highly desirable.

Efforts at making fuser roll structures more readily serviceable and inexpensive to make can be see in U.S. Pat. No. 4,280,443 issued in the name of Gregory V. Bogoshian and assigned to the same assignee as the instant application wherein there is disclosed to a roll fuser apparatus for fixing toner images on copy substrates. This apparatus is characterized by simplicity of design and serviceability. To this end, the fuser roll, pressure roll and a weighted wick are all supported for vertical movement such that raising the pressure roll which is below the fuser roll which, in turn, is below the wick causes engagement with the fuser roll and then engagement between the fuser roll and wick. Downward movement of the pressure roll will effect disengagement of the pressure roll from the fuser roll as well as automatic disengagement of the wick from the fuser roll.

Many structures have been devised for effecting pressure engagement between two roll fuser members an example of such being disclosed in U.S. Pat. No. 4,464,985 issued in the name of Saitama et al. As shown therein an adjusting rod 5 is coupled to a rotary shaft of pressing roller 3. The adjusting rod 5 is coupled to an arm 7 in such a manner that the distance between the arm and the rotary shaft 4 can be adjusted with an adjusting screw 6.

BRIEF SUMMARY OF THE INVENTION

Briefly, the present invention carries out its intended purposes by the provision of a pair of roll fuser members which are supported in the machine in which they are used such that the rolls can be easily serviced (including removal from the machine) and adjusted (while in the machine) for various desired applications. To these ends, there is provided a first roll member which is supported by a pair of support arms forming a part of latch mechanism including an over-center toggle structure. The support of this roll by these support arms is such that the roll need only be lifted off the arms in order to be removed from the machine. A shaft is provided which acts as an actuator mechanism to effect operation of the toggle structure. The shaft carries an adjustment plate having a plurality of notches which cooperate with a stud on the machine frame to support the shaft in one of a plurality of positions which correspond to different nip pressures. In order to adjust the roll nip pressure the shaft is lifted off the studs and the adjustment plate is rotated to align one of the notches with the stud depending on the nip pressure desired.

The toggle arrangement provides for the constant application of pressure in the nip in a relatiively simple manner.

DETAILED DESCRIPTION OF THE PREFERRED EMBODIMENT OF THE INVENTION

Figure 1:
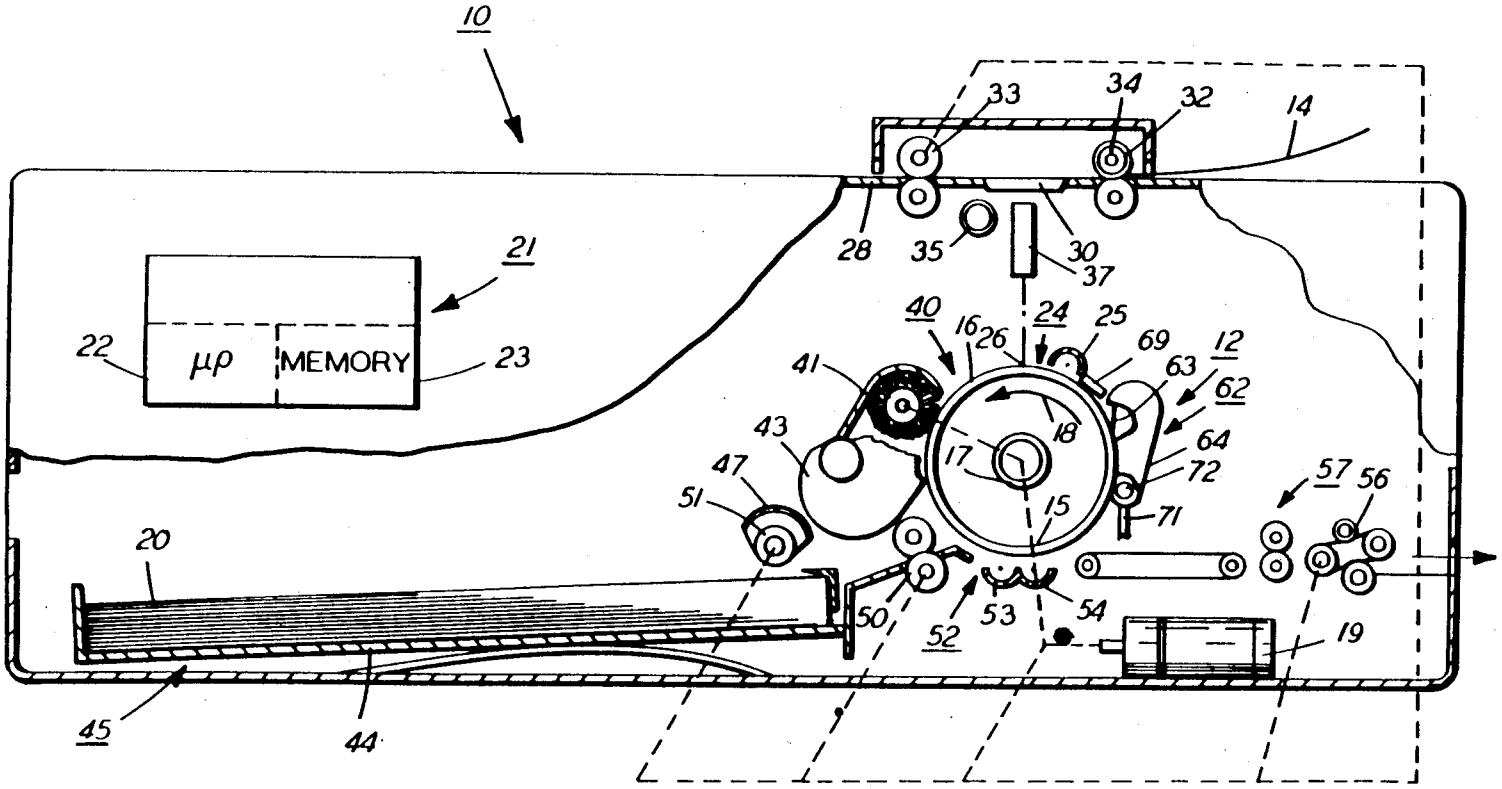
FIG. 1 is a side view depicting a xerographic reproduction machine or printer of the type adapted to incorporate the present invention.
Figure 2:
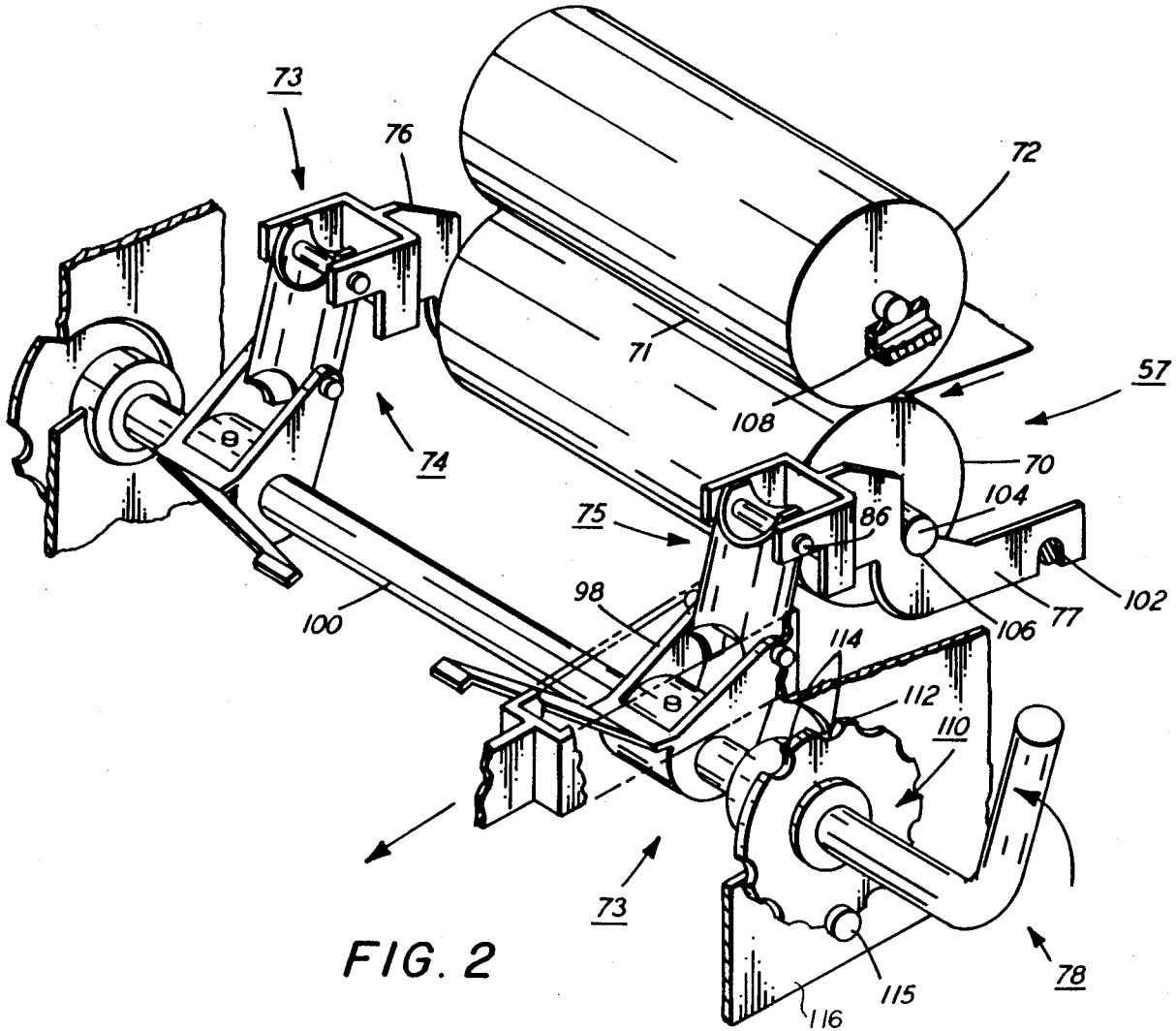
FIG. 2 is a perspective view of one embodiment of a fuser apparatus incorporating the inventive features of the invention.

Referring to FIG. 1 of the drawings, there is shown by way of example an automatic xerographic reproduction or printing machine, designated generally by the numeral 10.

The reproduction machine 10 depicted in FIG. 1 illustrates the various components utilized in machines of this type for producing copies of a document original 14. Although the present invention is particularly well adapted for use in reproduction machine 10, it should become evident from the following description that it is equally well suited for use in a wide variety of other reproduction and printing machine types and systems and is not necessarily limited in application to the particular embodiment of embodiments shown herein.

Reproduction machine 10 has an image recording photoreceptor 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to photoreceptor 15, motor 19 rotating photoreceptor 15 in the direction indicated by arrow 18 to bring the photoconductive surface 16 of photoreceptor 15 past a series of xerographic processing stations. A suitable controller 21 with microprocessor 22 and memory 23 is provided for operating in predetermined timed relationship the various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, suitable supporting surface or platen 28 for document original 14 is provided having a scan aperture or slit 30 therethrough. A suitable document transport, depicted herein as inlet and outlet constant velocity roll pairs 32,33 is provided for transporting the document original past scan slit 30. Roll pairs 32,33 are drivingly coupled to main drive motor 19, roll pair 32 being coupled through an electromagnetically operated clutch 34. A suitable document sensor (not shown) is provided at the inlet to platen 28 for sensing the insertion of a document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37, which may, for example, comprise an array of gradient index fiber elements, is provided to optically transmit the image ray reflected from the line-like portion of the document original being scanned to the photoconductive surface 16 of photoreceptor 15 at exposure station 26.

Following exposure, the latent image of the photoconductive surface 16 of photoreceptor 15 is developed at a development station 40. There, a suitable developer such as magnetic brush roll 41, which is drivingly coupled to main drive motor 19, brings suitable developer mix in developer housing 43 into developing elevation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets into operative relationship with segmented feed rolls 47. Feed rolls 49 are driven by main drive motor 19 through an electromagnetically operated clutch 51. Rolls 47 serve upon actuation of clutch 51 to feed the topmost copy sheet with the image on the photoconductive surface 16 of photoreceptor 15. Registration roll pair 50 advance the copy sheet to transfer station 52. There, suitable transfer/detack means such as transfer/detack corotrons 53,54 bring the copy sheet into transfer relation with the developed image on photoconductive surface 16 of photoreceptor 15. Registration roll pair 50 advance the copy sheet to transfer station 52. There suitable transfer/detack means such as transfer/detack corotrons 53,54 bring the copy sheet into transfer relation with the developed image on photoconductive surface 16 and separate the copy sheet there from for fixing and discharge as a finished copy.

Following transfer station 52 the image bearing copy sheet is transported to fuser 57 where the image is permanently fixed to the copy sheet.

Following transfer, residual developer remaining on the photoconductive surface 16 of photoreceptor 15 is removed at cleaning station 62 by means of cleaning blade 63 (FIG. 1). Developer removed by blade 63 is deposited into a suitable collector 64 for removal.

While a drum type photoreceptor is shown and described herein, it will be understood that other photoreceptor types may be employed such as belt, web, etc.

To permit effective and controlled charging of the photoconductive surface 16 by scortron 25 to a predetermined level necessitates that any residual charges on the photoconductive surface 16 or trapped in the photoreceptor be removed prior to charging. An erase device 69 is provided for this purpose.

At the cleaning station 62, the cleaning blade 63 is supported in contact with the photoreceptor 15 such that residual toner is chiseled therefrom.

Referring to FIGS. 2, 3, 4 and 5 it can be seen that the fuser 57 includes a heated fuser roll 70 and a pressure roll 72 which can be heated or not heated depending on the machine in which it is used. An elongated nip 71 of the type well known in the art is formed between the fuser and pressure rolls. The relatively high (i.e. 400 pounds total force on roll) pressure required to create the nip is effected by a latch mechanism generally indicated by reference character 73. The latch mechanism 73 includes a pair of over-center toggle structures generally indicated by the reference characters 74,75, a pair of support arms 76,77 operatively attached to the toggle members and adapted to support the roll member in various positions and a latch actuating device generally indicated by the reference character 78. Each of the toggle members 74,75 comprises a compression springs 80,81 which are concentrically mounted internally of a generally tubular shaped housing or toggle link 82.

Each of the springs 80 is retained by a pair of washers 84,85 disposed internally of the tubular shaped housing 82 which, in turn, is retained by a pair of shafts 86,87 which are inserted through apertures 88,89 and 92,93 in the tubular shaped housing. The shafts are provided with notched or flat areas 90 for receiving the washers 84,85. One of the springs 80, a pair of washers and a pair of shafts are assembled into one of the tubular shaped housings by inserting shaft 87 through two aligned apertures 88,89 followed by insertion of one of the washers, 84,85 and then one of the springs 80 through one end of the tubular housing, after which the other washer is inserted through the other end of the housing. The spring and washer is then compressed to allow insertion of the other shaft through another pair of apertures 92,93. The apertures are too small for the washers to fit through. Thus, once the washers are captivated by the shafts the components including the shafts are retained by the washers.

One end of a tubular shaped housing is pivotally attached to one of the support arms 76,77 by the shaft 86 while the other end thereof is pivotally attached to an element 98 of a toggle structure by the shaft 87. The element 98 is, in turn, fixedly secured in any suitable manner to an actuator shaft or actuator 100. Rotation of the actuator structure causes the over-center toggle structures to lift the support arms 76,77 in an upwardly direction to thereby effect pressure engagement of the two rolls 70,72. To this end each of the support arms is pivotally supported by stub shafts 102 (only one being shown) carried by a machine frame member (not shown) and the shaft 104 of the roll member 72 is received in recesses 106 provided in the support arms. The roll 70 rests on a pair of supports 108 from which it is lifted as the roll 72 is raised upwardly by the latch mechanism 73. The over-center action of the latch mechanism cause the rolls to remain engaged until the actuator structure 100 is rotated in the opposite direction.

An adjustment device 110 comprises an adjustment plate 112 carried by the shaft 100 and having a plurality of notches 114 therein, each of which is adapted to receive a support stud 115 carried by a machine frame member 116. The depth of the notches varies so that the rest position of the shaft 100 can be modified in order to enable the toggle structure to exert a greater or lesser force in the roll nip in accordance with the notch in which the stud is received.

Thus, the nip pressure between the two rolls can be adjusted to compensate for varying manufacturing tolerances as well as to accommodate the use of the mechanism in different machines. To make an adjustment, the rolls are first disengaged and the shaft and toggle structure are lifted clear of the support stud 115 after which the shaft 100 is rotated so that the desired notch is brought into alignment with the stud 115. After a suitable adjustment is made the shaft and plate member are lowered such that the stud 115 is received in the appropriate notch 114. While a shaft is illustrated as the latch actuator a member which is moved through a linear motion as opposed to the rotary motion caused by the shaft is also contemplated. For example, an element could be operatively connected to the shaft 87 interconnecting a tubular shaped housing and a toggle element or link member 98.

Figure 4:
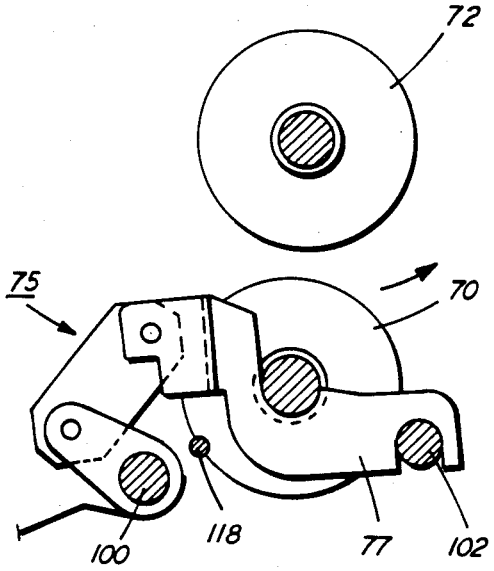
FIG. 4 is a side elevational view of an over-center toggle mechanism in its inoperative position.
Figure 5:
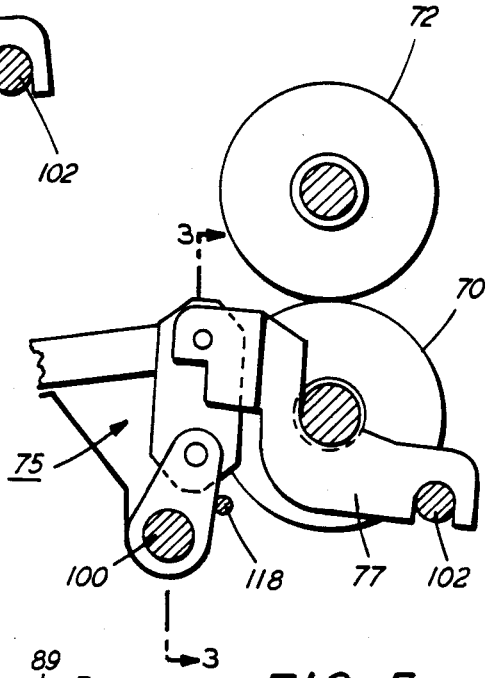
FIG. 5 is a side elevational view of of an over-center toggle mechanism in its operative position.
Figure 3:
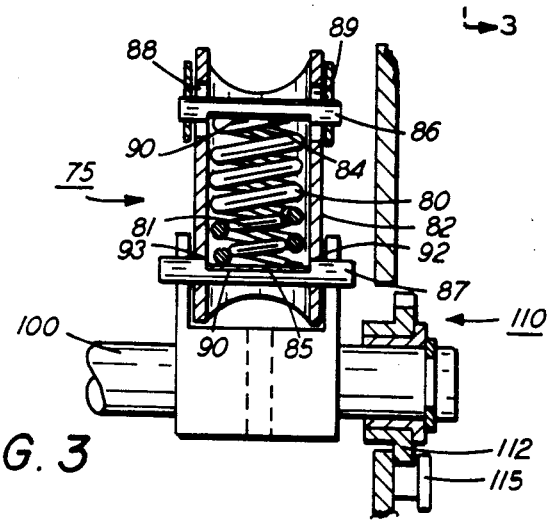
FIG. 3 is a fragmentary view partly in cross section of an over-center toggle member forming a part of the present invention.

During inoperative (i.e. imaging fusing is not taking place) periods the rolls 70 and 72 may be disengaged as depicted in FIG. 4 and and during operation the rolls are pressure engaged to form the nip 71 as indicated in FIG. 5. In operation, the rolls have actually been in engagement during inoperative periods. An over-center stop 118, FIG. 4 serves to limit the movement of the toggle structure.

In view of the foregoing description, it can now be appreciated that the present invention comprises a roll fuser latch mechanism which not only effects pressure engagement of the two rolls of the fuser but it also serves as the support for one of the rolls. to this end the latch mechanism comprises a pair of support arms which cradles the one roll and an actuator structure which are interconnected via an over-center toggle structure forming an integral part of the latch mechanism. The toggle structure comprises compression springs captivated in one of two toggle links forming part of the over-center toggle structure.

What is claimed is:

1. Latch mechanism for a heat and pressure roll fuser, said apparatus comprising:

a pair of pivotally supported support arms for supporting one of a pair of rolls forming said fuser, said one of a pair of rolls including shaft members;

means for supporting another roll of said fuser so that it is disposed substantially above said one of a pair of rolls;

an actuator member operably supported for cooperation with said pair of support arms;

means interconnecting said support arms to said actuator member and operative in at least one position to apply a force sufficient to force said one roll into pressure engagement with said another roll upon actuation of said actuator member;

said pair of support arms, interconnecting means and said actuator member comprising the sole means for operatively supporting said one of a pair of rolls;

said support arms each being provided with a recess for receiving and captivating said shaft members for movement with said support arms;

said interconnecting means comprising a pair of over-center toggle structures wherein each of said toggle structures comprises a first toggle link fixedly secured to said actuator member and a second toggle link pivotally secure to one of said support arms;

a compression spring in said second toggle link for effecting pressure engagement of said rolls when said latch mechanism is actuated; and a pair of washers for retaining said compression spring and a pair of shafts for retaining said washers in said second toggle link, said shafts being provide with a notched area for receiving at least a part of said washer whereby said shafts are captivated in said second toggle link.

2. Apparatus according to claim 1 incuding an adjustment mechanism carried by said actuator for varying the degree of pressure engagement between said rolls.

3. Apparatus according to claim 2 wherein said actuator member comprises a rotatable shaft.

4. Apparatus according to claim 3 wherein said adjustment mechanism comprises at least one plate having a plurality of different size notches therein and wherein said plate is rotatable on said shaft for effecting engagement of a selected one of said notches with a support member.

5. Heat and pressure fuser apparatus for fixing toner images to copy substrates which are passed between a pair of fuser rolls of said apparatus, said apparatus comprising a latch mechanism including:

a pair of pivotally supported support arms for supporting one of a pair of rolls forming said fuser, said one of a pair of rolls including shaft members;

means for supporting another roll of said fuser so that it is disposed substantially above said one of a pair of rolls;

an actuator member operably supported for cooperation with said pair of support arms;

means interconnecting said support arms to said actuator member and operative in at least one position to apply a force sufficient to force said one roll into pressure engagement with said another roll upon actuation of said actuator member;

said pair of support arms, interconnecting means and said actuator member comprising the sole means for operatively supporting said one of a pair of rolls;

said support arms each being provided with a recess for receiving and captivating said shaft members for movement with said support arms;

said interconnecting means comprising a pair of over-center toggle structures wherein each of said toggle structures comprises a first toggle link fixedly secured to said actuator member and a second toggle link pivotally secure to one of said support arms;

a compression spring in said second toggle link for effecting pressure engagement of said rolls when said latch mechanism is actuated; and a pair of washers for retaining said compression spring and a pair of shafts for retaining said washers in said second toggle link, said shafts being provided with a notched area for receiving at least a part of said washer whereby said shafts are captivated in said second toggle link.

6. Apparatus according to claim 5 including an adjustment mechanism carried by said actuator for varying the degree of pressure engagement between said rolls.

7. Apparatus according to claim 6 wherein said actuator member comprises a rotatable shaft.

8. Apparatus according to claim 7 wherein said adjustment mechanism comprises at least one plate having a plurality of different size notches therein and wherein said plate is rotatable on said shaft for effecting engagement of a selected one of said notches with a support member.

9. An over-center toggle structure for use in a latch mechanism for effecting pressure engagement of a pair of fuser rolls, said apparatus comprising:

a first toggle link fixedly secured to an actuator member of said latch mechanism and a second toggle link pivotally secured to a support arm of said latch mechanism wherein one of said toggle links contains a compression spring structure internally thereof which is retained therein by a pair of washers which are in turn retained by a pair of shafts, said shafts having a notched area for receiving at least part of one of said washers whereby said shafts are captivated in said second toggle link.

* * * * *